US007240963B2

(12) United States Patent
Stanley

(10) Patent No.: US 7,240,963 B2
(45) Date of Patent: Jul. 10, 2007

(54) HAND RAIL ASSEMBLY INCORPORATING ARTICULATING SEATS

(76) Inventor: Larry S. Stanley, 66 John F. Kennedy Blvd., Pine Beach, NJ (US) 08741

( * ) Notice: Subject to any disclaimer, the term of this patent is extended or adjusted under 35 U.S.C. 154(b) by 240 days.

(21) Appl. No.: 11/062,269

(22) Filed: Feb. 22, 2005

(65) Prior Publication Data

US 2006/0186389 A1 Aug. 24, 2006

(51) Int. Cl.
*A47C 1/00* (2006.01)

(52) U.S. Cl. ..... 297/217.7; 297/335

(58) Field of Classification Search ..... 297/217.7, 297/217.1, 331, 335, 14
See application file for complete search history.

(56) References Cited

U.S. PATENT DOCUMENTS 5,393,120 A * 2/1995 Woods et al. ..... 297/301.3
5,421,131 A * 6/1995 Heckman et al. ..... 52/263
5,516,179 A * 5/1996 Tidwell ..... 296/63
5,653,178 A * 8/1997 Huczka ..... 108/47
5,899,531 A * 5/1999 Koehler ..... 297/335
6,293,621 B1 * 9/2001 Marsh et al. ..... 297/335
7,000,989 B2 * 2/2006 Fisher ..... 297/335
2003/0090137 A1 * 5/2003 Piretti ..... 297/335
2006/0071510 A1 * 4/2006 Jiang ..... 297/14

* cited by examiner

*Primary Examiner*—David Dunn
*Assistant Examiner*—Sarah B. McPartlin
(74) *Attorney, Agent, or Firm*—Clifford G. Frayne

(57) ABSTRACT

A security handrail system having a plurality of vertical post members securable in a vertical orientation to a stratum, the vertical post members intersected by a plurality of horizontal cross members, there being articulatingly secured between adjacent vertical post members, an articulating seat member rotatable from a vertical position flush with the plane of the handrail security system to a substantially horizontal plane allowing a user to orient himself in a sitting position for a temporary period of time. The seat member is capable of being formed with a biasing means, automatically returning the seat member to a vertical orientation when weight is removed.

16 Claims, 6 Drawing Sheets

HAND RAIL ASSEMBLY INCORPORATING ARTICULATING SEATS

BACKGROUND OF THE INVENTION

1. Field of the Invention

The present invention relates to security hand rail assemblies, and in particularly, to a reinforced hand rail security assembly incorporating articulating mounted seats, the reinforced hand rail security system of the present invention primarily used in containing and directing individuals in a queue or waiting area.

2. Description of the Prior Art

Security railing assemblies have long been used for a variety of applications, such as multi-story buildings with stairways and balconies, industrial buildings, playgrounds and schools, and as directional indicators for long lines of individuals such as directing the queue of individuals within a bus station, air port, train station, or in amusement parks where long lines of individuals stand in line in order to gain access to a particular ride. Many of these uses are outdoors where the security railing is exposed to the weather and other corrosive elements, such as salt water, chemical vapors and the like. Building codes require the use of high strength materials, such as iron, steel, aluminum or the like to provide sufficient rigidity and strength to insure adequate security qualities. These types of railing systems often present a problem of rusting and/or corrosion of the metallic parts. In addition to the corrosion being unsightly and requiring constant care and upkeep, the corrosion of the security railing system degrades the strength to the point where they are no longer capable of functioning for their intended purpose.

Applicant is the developer of a reinforced plastic handrail security system and evidenced in U.S. Pat. No. 5,303,900 and U.S. Pat. No. 6,203,233.

Applicant has further developed a reinforced plastic handrail security system for particular application to the situations where a large number of individuals must be channeled or directed to a particular location or must remain in a particular configuration or area before gaining access to another area. Railing systems of this type are particularly used in bus stations, air ports, train stations, and amusement parks. For example, in amusement parks, large numbers of individuals may wish to gain access to a particular amusement ride and therefore must stand or queue in line until they have reached the front of the line where their access is allowed. In some instances people must stand in the queue for a significant amount of time, e.g. 40 minutes to an hour. Individuals seeking access to the amusement ride are of all ages, including young children and older adults. At the present time, individuals in such queues or waiting areas had no choice but to stand in line and shuffle forward as the line decreased, or if becoming tired, sit on the ground or lean on the railing system.

Applicant has developed an articulating mounted seating means which is incorporable with the railing system which provides an articulating seat mounted between vertical elements of the railing system.

OBJECTS OF THE INVENTION

An object of the present invention is to provide for a novel handrail security assembly which incorporates an articulated seat member which seat member is flush with the railing system when not in use and when in use, provides a temporary seat for an individual in the queue.

Another object of the present invention is to provide for a novel handrail assembly and articulating seat in which the seat member when not in use is flush with the plane of the railing system.

A still further object of the present invention is to provide for a novel railing assembly and articulating seat in which the seat automatically returns to its vertical flush position with the railing system after use.

A still further object of the present invention is to provide for a novel handrail assembly and articulating seat in which the hand rail system and the articulating seat are suitably fabricated so that there is no rusting or corrosion of the parts.

A still further object of the present invention is to provide for a novel hand rail security assembly and articulating seat, wherein the seat member can be secured to the security handrail system as an aftermarket item.

A still further object of the present invention is to provide for a novel handrail security assembly and articulating seat wherein the articulating seat and handrail security assembly are fabricating in multiple sections for installation which allows the user the flexibility in the design of the queue system or waiting area.

SUMMARY OF THE INVENTION

A security handrail assembly having a plurality of vertical post members securable in a vertical orientation to a stratum, the vertical post members intersected by a plurality of horizontal cross members, there being articulatingly secured between adjacent vertical post members, an articulating seat member rotatable from a vertical position flush with the plane of the handrail security assembly to a substantially horizontal plane allowing a user to orient himself in a sitting position for a temporary period of time. The seat member may incorporate a biasing means for automatically returning it to a vertical orientation when weight is removed.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
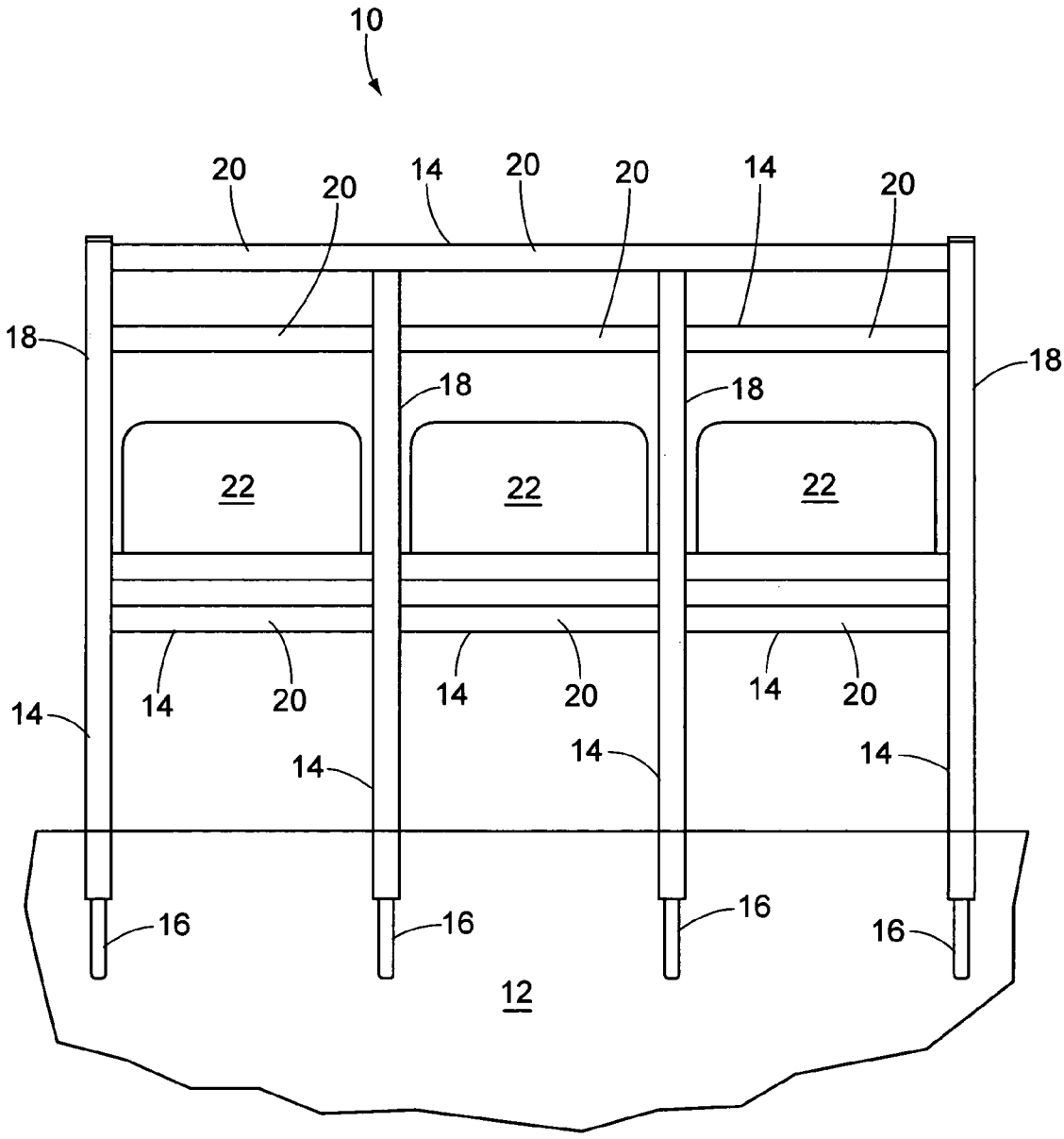
FIG. 1 is a front planar view of a section of a handrail security system incorporating the articulating seats of the present invention.

FIG. 1 illustrates a section of a security hand rail assembly 10 in accordance with the present invention. Security railing 10 is installed on a support surface 12 which can be wood, concrete or other suitable substrate normally found in home, commercial or industrial settings where railings are used. It will be appreciated that the number of sections which can be joined together may vary depending upon the size of the area where the railing system is to be installed. The portion of the railing system illustrated in FIG. 1 illustrates three units of railing.

The security hand rail assembly 10 may be constructed of any suitable material, i.e. aluminum, steel or the like. The preferred embodiment will be described with respect to Applicant's tubular plastic hand rails described in the aforementioned patents. The rail units and posts are made of tubular plastic material, preferably acrylic (ASA) or polyvinyl chloride plastic (PVC) pipe and/or tubing 14. The pipe or tubing may be suitably reinforced with fibers or the like in accordance with known state of the art techniques where additional strength and/or rigidity is required. The pipes have a smooth, gloss, satin or matte finish and may be made in a variety of colors by adding pigment to the extrusion material.

Typically a size of pipe found suitable for the present invention can vary, however a pipe having an outside diameter of two inches and a wall thickness of at least one eighth inch would be suitable, although larger and smaller size tubing may be used depending upon the intended use while not departing from the spirit and scope of the invention.

The plastic material is impervious to corrosive elements such as salt, spray, rain, snow and extreme heat, as well as corrosive chemical atmospheres. Preferably, the pipe is fire resistant and resistant to denting, scratching, and other physical abuse. As illustrated in FIG. 1, the plastic pipe or tubing is reinforced by a metal pipe insert 16 whose outer diameter is dimensioned to the inner diameter of the plastic pipe or tubing 14. The rail system comprises a plurality of vertical perpendicular posts 18 comprised of the plastic pipe 14 and the metal pipe insert 16 being imbedded in a suitable base or stratum 12. The perpendicular vertical posts 18 are joined by a plurality of cross members 20 which form the railing system or assembly.

In the instant invention, the rail system 10 has disposed between each adjacent perpendicular vertical post 18 an articulating seat member 22 shown and illustrated in FIG. 1 in an upright and unused orientation. The articulating seat member 22 may be rotated to a substantially horizontal position to allow for an individual in the queue or waiting area to sit down and rest on a temporary basis. When the weight of the individual is released from the seat member 22 when it is in a substantially horizontal position, the seat member 22, can be returned to the vertical orientation shown and illustrated in FIG. 1.

Figure 2:
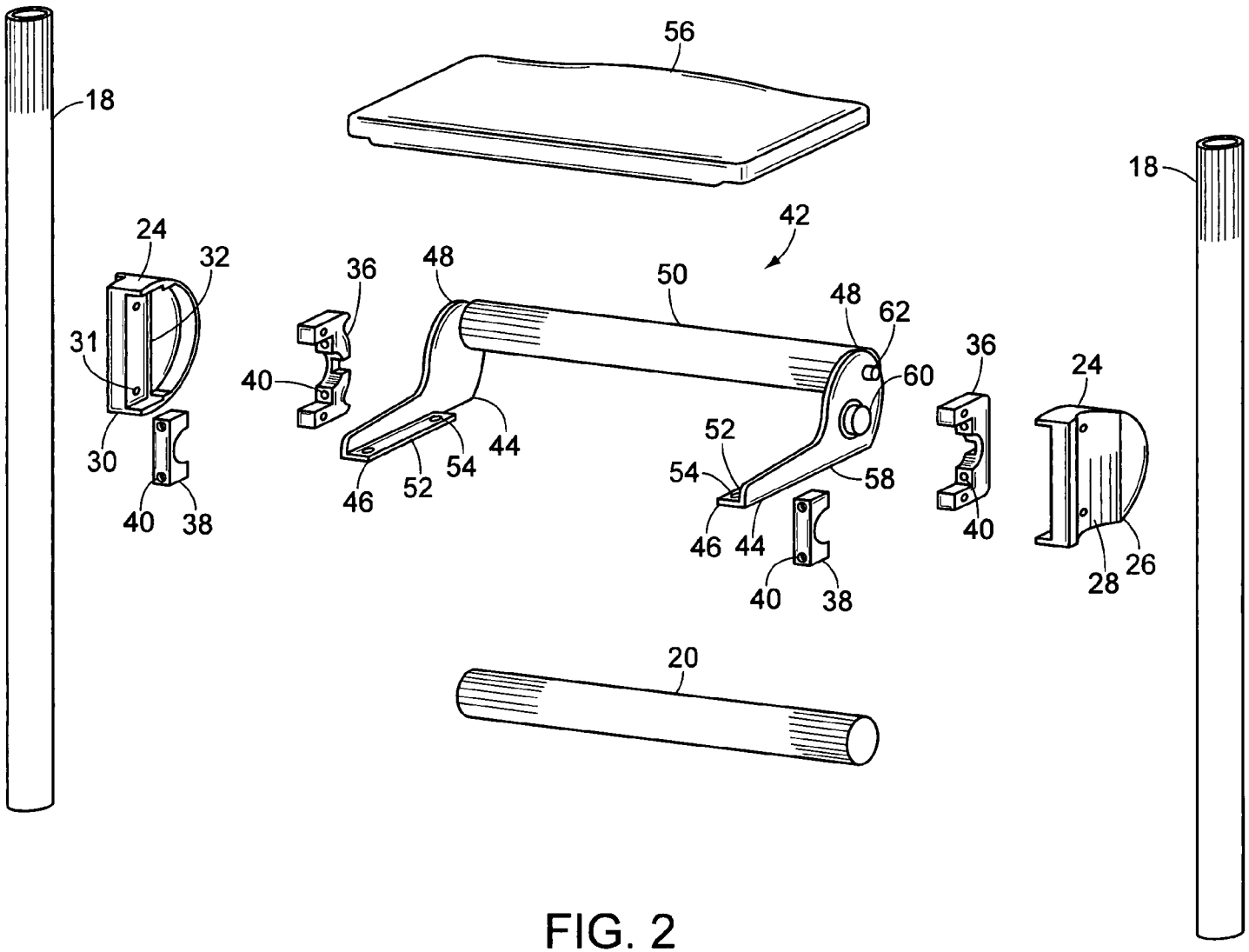
FIG. 2 is an exploded perspective view of the elements of the articulating seat member.
Figure 3:
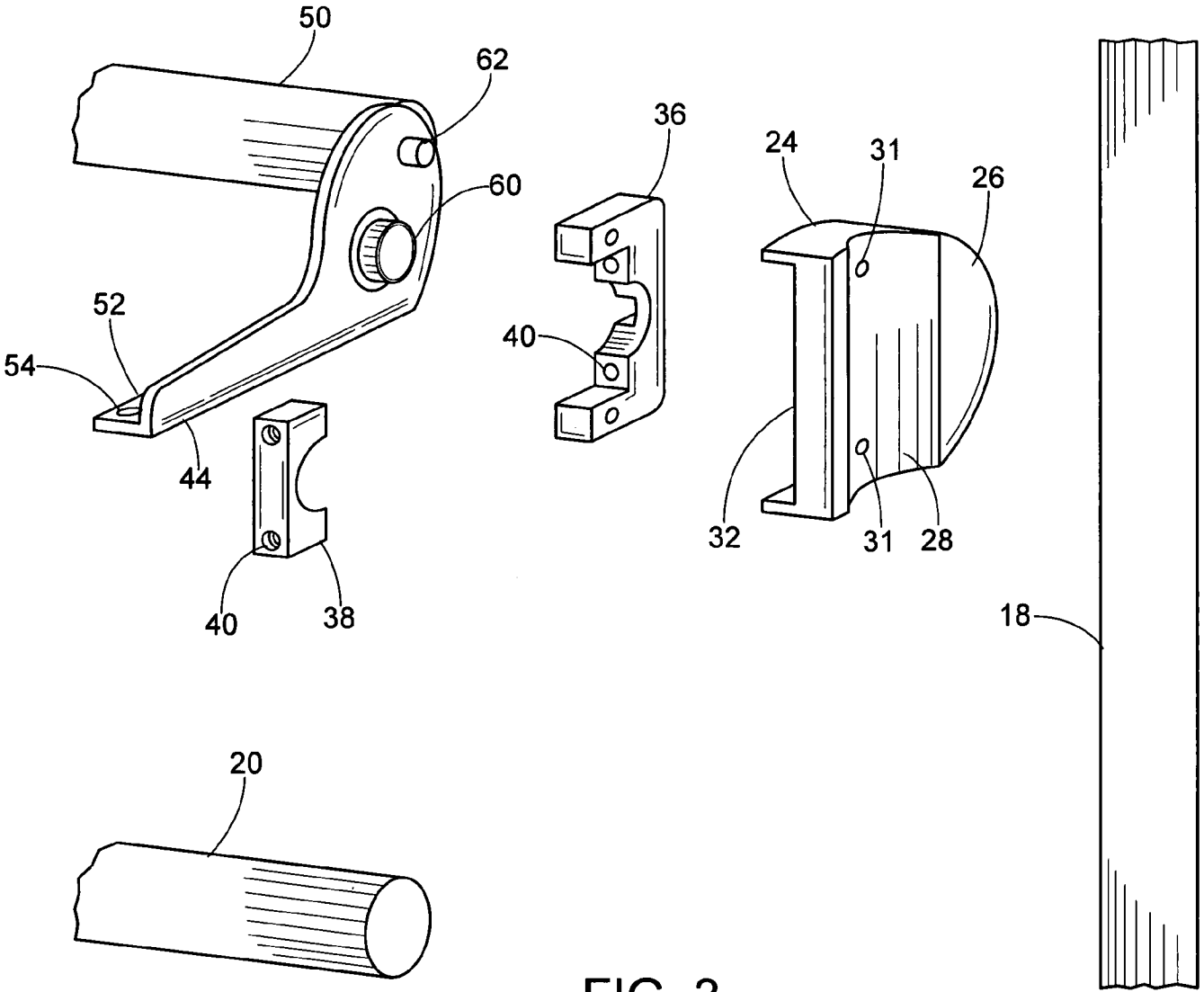
FIG. 3 is a close up perspective view of one end of the seat member.

FIGS. 2 and 3 are exploded views of the articulating seat member 22 and the means by which it is cooperatively mounted between two perpendicularly vertical adjacent posts 18. FIGS. 2 and 3 incorporated a biasing means which automatically returns the seat to its vertical orientation. While FIG. 2 is illustrated with vertical tubular members of circular cross section it will be appreciated that tubular members of other geometric cross section may be utilized.

A mounting bracket 24 is secured to the vertically perpendicular adjacent posts 18 at equal heights. The mounting bracket has a first face surface 26 comprising a semi-cylindrical groove 28 whose arc is complimentary with the arc of the outer diameter of the perpendicular vertical post 18. The opposing face surface 30 of mounting bracket 24 has a bearing receiving face 32.

Throughbores are formed in the mounting bracket 24 from the bearing receiving face 32 to the first face surface 26 for the receipt of a securing means 34 which will secure the mounting bracket 24 to the respective vertical perpendicular post 18.

A first bearing surface 36 and a second bearing surface 38 are receivable within the bearing receiving face 32 of mounting bracket 24. The first bearing surface 36 and second bearing surface 38 are complimentary and are positioned after the seat member has been positioned in the first bearing surface 36 as described hereafter. The first bearing surface 36 and the second bearing surface 38 have throughbores 40 therethrough alignable with a bore in the mounting bracket 24 so that the bearing surfaces 36 and 38 may be secured at the completion of assembly.

The mounting bracket 24 and first and second bearing surfaces 36 and 38 are for receipt of an articulating seat support 42 generally comprised of two parallelledly disposed arms 44 having first ends 46 and a second ends 48, parallelledly disposed arms 44 are secured by a counter weight bar 50 proximate the second end 48 and seat 56. The first end 46 of the opposing parallelledly disposed arms 44 are L-shaped in cross sectional area forming a flange 52 having throughbores 54 there through for securing the seat 56 to the seat support 42.

Formed on the outer surface 58 of opposing parallelledly disposed arms 44 are two opposing cylindrical bushings 60 whose circumference surface is complimentary with the bearing surface formed when first bearing surface 36 and second bearing surface 38 are secured together.

Also formed proximate the second end 48 of opposing parallelledly disposed arms 44 of articulating seat support 42 are stop members 62 which engage with the mounting bracket 24 to limit the rotation of the seat 56 and articulating seat support 42 from a horizontal to vertical orientation.

In assembly, opposing mounting brackets 24 would be secured to adjacent perpendicular vertically disposed posts 18. First bearing surfaces 36 would then be inserted into the bearing receiving face 32 of the mounting bracket 24. The articulating seat support 42 would then be positioned with the opposing cylindrical bushings 60 being in engagement with the first bearing surface 36. Second bearing surface 38 would then be inserted into the bearing receiving face 32 of mounting bracket 24 so that the opposing cylindrical bushings 60 would then be encapsulated by the first bearing surface 36 and the second bearing surface 38. A securing means would then be engaged through the through bores in the first bearing surface 36 and the second bearing surface 38 and into the mounting bracket 24 thereby securing the articulating seat support 42 between the mounting brackets 24 and the adjacent vertical posts 18. The seat 56 could then be installed to the flanges 52 of the first end 46 of the articulating seat support 42 if not already so secured.

Figure 4:
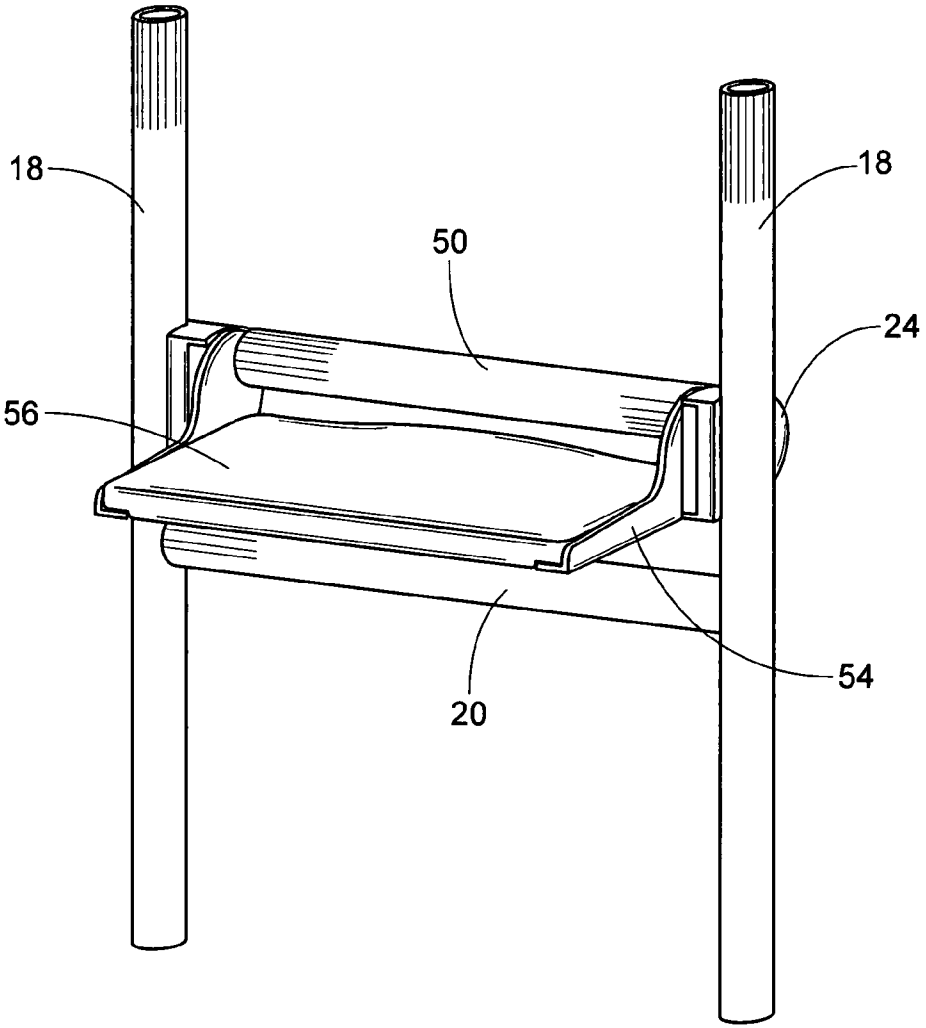
FIG. 4 is a perspective view of the seat member in its horizontal orientation for accepting the weight of an individual in a sitting position.

In this configuration, the counterweight bar 50 is of a sufficient weight that the articulating seat support and seat 42 and 56 will rotate to a vertical position substantially in the plane of the guardrail system. Such a seat support 42 and seat 56 would be positioned between every adjacent vertical post 18 or could be randomly positioned between adjacent vertical posts when the vertical posts are used in a railing system 10 which serves as a directional or queue or waiting area for individuals. An individual wishing to rest while in a queue or waiting area of such railing system 10 would merely grasp the seat 56 and with pressure cause the seat and the articulating seat support 42 to rotate to a horizontal position, the rotating automatically ceasing when the stop member 62 contacts the mounting bracket 24 (See FIG. 4). The individual could then utilize the seat 56 to rest for a period of time before having to move. When the individual stands up, the weight of the counterweight bar 50 will cause the articulating seat support 42 and seat 56 to rotate upwardly into a vertical plane which is again substantially in the plane of the guard rail system 10 such that it does not interrupt the flow of individuals or traffic through the queue.

In practice, the mounting brackets would be mounted on adjacent vertical posts 18 such that when the articulating seat support 42 and seat 56 were rotated into a horizontal, sitting position, the height of the seat 56 would be approximately 23 to 24 inches off the ground. Naturally this height could be varied depending upon the intended use of the safety railing system and the type of queue or waiting area involved. However, 23 inches has been found to be the optimum height to accommodate both children and adults.

All of the elements of the seat support 42 and seat 56 would be fabricated from suitable materials depending upon the installation location, i.e. indoors or outdoors.

Still further, the width of the articulating seat support 42 and seat 56 could vary depending upon the design distance between adjacent vertical posts 18. In the instant illustration, for optimum strength and durability, the vertical posts 18 are approximately 22 inches apart with the distance from the outer surface of the opposing parallelledly disposed arms 44 being approximately 20 inches thereby leaving a gap of one inch on each side of the articulating seat support 42 which limits the possibility of a pinching action occurring to the fingers when the articulating seat support 42 and seat 56 rotate to a vertical position after use.

Figure 7:
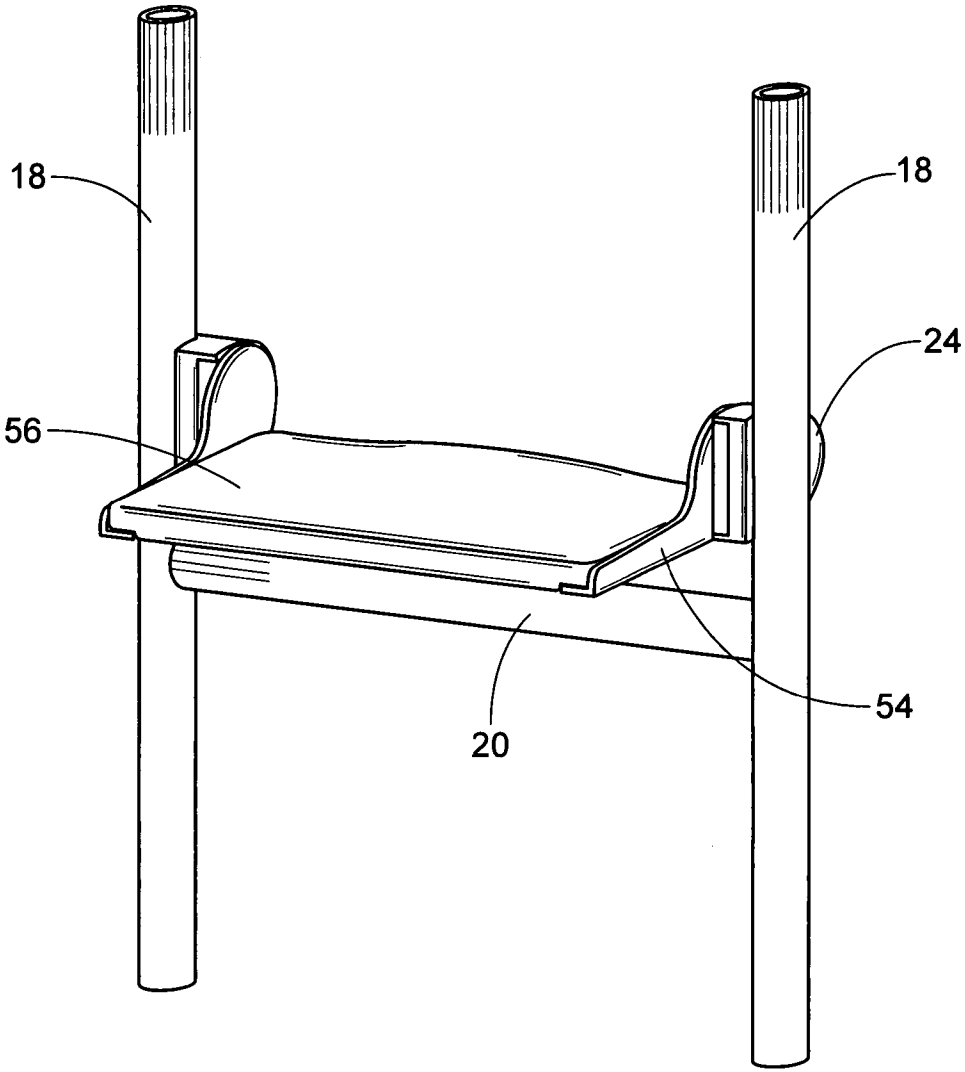
FIG. 7 is a perspective view of a third embodiment of the seat member.

In some instances it may be desireable not to have the seat automatically returned to vertical orientation after the weight is removed. In those instances, as illustrated in FIG. 7, the counterweight 50 would be eliminated from the seat assembly. The remaining portion of the assembly would be identical to that as explained heretofore. In these instances, the user would lift the seat to the vertical orientation when not in use, or in some instances, an attendant would periodically check the security hand rail assembly 10 and lift seats in a horizontal orientation to a vertical orientation manually.

Figure 6:
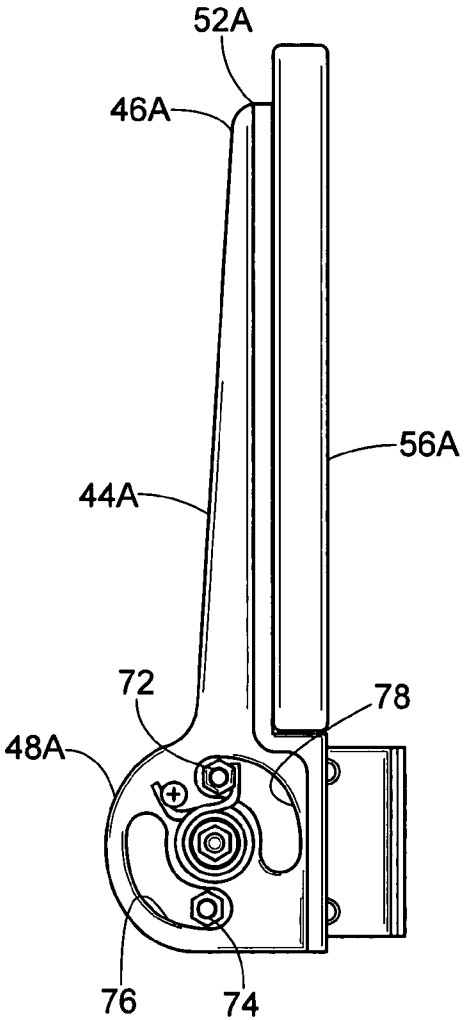
FIG. 6 is a side view of the second embodiment.
Figure 5:
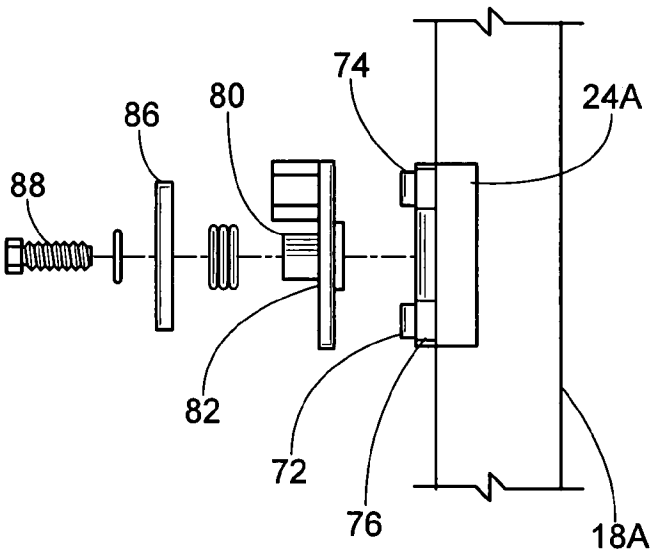
FIG. 5 is a partial exploded front view of a second embodiment of an articulating seat member of the present invention.

FIGS. 5 and 6 illustrate a second embodiment of the hand rail assembly with alternative biasing means.

This assembly utilizes a seat support block 24A with bushing 70 mounted to vertical tubular member 18A. Support block 24A has two outwardly extending finger members 72 and 74. Seat support arms 44A having first ends 46A and second ends 48A are slightly modified for this embodiment. First ends 46A of the opposing parallelledly disposed support arms 44A are L-shaped in cross sectional area forming a flange 52A with throughbores there through for the securing of a seat 56A. The second ends 48A are formed with two opposing arcuate cutouts 76 and 78 in which finger members 72 and 74 protrude and ride. The interior side of support arms 44A include a centrally disposed hub 80 about which a concentric bias spring means 82 is disposed, the spring means 82 having divergent ends 84 which wrap contact and engage finger members 72 and 74 extending from support block 24A. A cover 86 and a fastening means 88 are then disposed over the spring means 82 with the fastening means 88 extending though the cover 86, centrally disposed hub 80, outer wall of the support arm 44A and into support block 24A.

In this manner, the downward rotation of the seat assembly 42A will cause the spring means 82 to contract. Release of weight onto the seat assembly 42A will release the spring means returning the support arms 44A and seat 56A back to a vertical orientation.

The rail system illustrated utilized tubular posts and rails of circular cross section. However, the present invention can be utilized with tubular posts and rails of a geopmetric cross section other than circular.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

What is claimed is:

1. A security hand rail assembly incorporating articulating seats, the hand rail assembly comprising:

a plurality of vertical support posts in spaced apart relationship secured to a base, and a plurality of horizontal rails interconnecting said vertical support posts;

an articulating seat member disposed between adjacent vertical support posts, said articulating seat member comprising a pair of mounting brackets having a first face and a second face, said first face formed to mount flush with one of said adjacent vertical support posts, said second face having a bearing receptacle, said mounting brackets mounted to adjacent vertical support posts;

said second face of said mounting bracket having said bearing receptacle for receipt of a complimentary bearing surface wherein said bearing surface is formed of two complimentary bearing surfaces with complimentary alignable throughbores for receipt of a securing means to secure said bearing surface to said second face of said mounting bracket;

a pair of complimentary seat support arms having a first and a second end, said seat support arms in secured relationship to each other, each of said seat support arms having an outwardly disposed bushing rotatably, securably mounted in said bearing surfaces on said mounting bracket, said seat support arms having a seat member secured thereto rotatable from a vertical orientation to a horizontal orientation for sitting.

2. The security hand rail assembly incorporating articulating seats in accordance with claim 1 wherein said first face of said mounting bracket is formed to mate with said vertical support posts.

3. The security hand rail assembly incorporating articulating seats in accordance with claim 1 wherein said first face of said mounting bracket is formed with semi-cylindrical groove, said groove is semi-cylindrical in order to mate with said vertical support posts of cylindrical cross section.

4. The security hand rail assembly incorporating articulating seats in accordance with claim 1 wherein said mounting bracket is formed with a plurality of throughbores from said second face to said first face in order to mount said mounting bracket to said vertical support posts.

5. The security hand rail assembly incorporating articulating seats in accordance with claim 1 wherein said seat support arms are L-shaped in cross section at said first end and have a plurality of apertures formed therethrough for receipt of a securing means to secure said seat member.

6. The security hand rail assembly incorporating articulating seats in accordance with claim 1 wherein said support arms are secured to each other by a counterweight at said second end, said counterweight automatically returning said support arms and said seat member to a vertical orientation when weight is removed from said seat.

7. The security hand rail assembly incorporating articulating seats in accordance with claim 1 wherein said support arms have outwardly extending stop members at their second end, said stop members engaging said mounting bracket to limit rotation of said seat support arms and said seat 90° from a vertical orientation to a horizontal orientation.

8. The security hand rail assembly incorporating articulating seats in accordance with claim 1 wherein said support arms are formed with a spring biasing means at said second end, said spring biasing means returning said support arms and said seat member to a vertical orientation when weight is removed from said seat.

9. A security hand rail assembly incorporating articulating seats, the hand rail assembly comprising:

a plurality of vertical support posts in spaced apart relationships secured to a base, and a plurality of horizontal rails interconnecting said vertical support posts;

an articulating seat member disposed between adjacent vertical support posts, said articulating seat member comprising a pair of mounting brackets having a first face and a second face, said first face formed to mount flush with one of said adjacent vertical support posts, said second face having a bearing receptacle, said mounting brackets mounted to adjacent vertical support post;

said second face of said mounting brackets having said bearing receptacle for receipt of a complimentary bearing surface; said bearing surface having complimentary aligned throughbores for receipt of a securing means for securing said bearing surface to said mounting brackets bearing receptacle;

a pair of complimentary seat support arms having a first end and a second end, said seats support arms in secured relationship to each other, each of said seat support arms having an outwardly disposed bushing rotatably securably mounted in said bearing surfaces on said mounting brackets, said seat support arms having a seat member secured thereto, said seat support arms further having a biasing means for automatically returning said seat support arms and said seat member to a vertical orientation from a horizontal orientation once weight is removed from said seat member.

10. The security hand rail assembly in accordance with claim 9 wherein said biasing means comprises a counterweight disposed between said pair of complimentary seat support arms for returning said seat to a vertical orientation from a horizontal orientation upon removal of weight.

11. The security hand rail assembly in accordance with claim 9 wherein said biasing means comprises a spring means incorporated in said second end of said seat support arms, said spring biasing means compressed upon the receipt of force upon said seat member, said spring biasing means released upon removal of said force upon said seat member returning said seat member to a vertical orientation.

12. The security hand rail assembly incorporating articulating seats in accordance with claim 9 wherein said first face of said mounting brackets is formed with semi-cylindrical groove, said groove is semi-cylindrical in order to mate with a vertical support post of cylindrical cross section.

13. The security hand rail assembly incorporating articulating seats in accordance with claim 9 wherein said mounting brackets are formed with a plurality of throughbores from said second face to said first face in order to mount said mounting brackets to said vertical support posts.

14. The security hand rail assembly incorporating articulating seats in accordance with claim 9 wherein said bearing surface is formed of two complimentary bearing surfaces with complimentary alignable throughbores for receipt of a securing means to secure said bearing surface to said second face of said mounting brackets.

15. security hand rail assembly incorporating articulating seats in accordance with claim 9 wherein said seat support arms are L-shaped in cross section at said first end and have a plurality of apertures formed therethrough for receipt of a securing means to secure said seat member.

16. The security hand rail assembly incorporating articulating seats in accordance with claim 9 wherein said support arms have outwardly extending stop members at their second end, said stop members engaging said mounting brackets to limit rotation of said seat support arms and said seat 90° from a vertical orientation to a horizontal orientation.

* * * * *